US008516727B1

(12) United States Patent
Maraia

(10) Patent No.: US 8,516,727 B1
(45) Date of Patent: Aug. 27, 2013

(54) METHODS OF ORGANIZING, IDENTIFYING AND DIFFERENTIATING WIRES, CORDS, CONNECTORS AND OTHER ELONGATED OBJECTS

(76) Inventor: Micah L. Maraia, Menomonie, WI (US)

( * ) Notice: Subject to any disclaimer, the term of this patent is extended or adjusted under 35 U.S.C. 154(b) by 0 days.

(21) Appl. No.: 12/657,874

(22) Filed: Jan. 30, 2010

Related U.S. Application Data

(63) Continuation of application No. 11/895,510, filed on Aug. 24, 2007, now abandoned.

(60) Provisional application No. 60/840,094, filed on Aug. 26, 2006.

(51) Int. Cl.
*G09F 3/00* (2006.01)

(52) U.S. Cl.
USPC ..... 40/316; 40/5; 40/661

(58) Field of Classification Search
USPC ..... 40/657, 656, 647
See application file for complete search history.

(56) References Cited

U.S. PATENT DOCUMENTS

| | | | | |
|---|---|---|---|---|
| 4,656,767 | A * | 4/1987 | Tarrant | 40/316 |
| 5,115,586 | A | 5/1992 | Hawker | |
| 5,170,578 | A * | 12/1992 | Pampel | 40/316 |
| 5,315,774 | A | 5/1994 | Chompff | |
| 5,638,624 | A * | 6/1997 | Cornu | 40/316 |
| 6,237,263 | B1 | 5/2001 | Hagstrom et al. | |
| 7,091,421 | B2 * | 8/2006 | Kukita et al. | 174/112 |
| 7,331,130 | B2 * | 2/2008 | Schweikert | 40/299.01 |
| 7,340,856 | B1 * | 3/2008 | Kalouris | 40/658 |
| 7,437,840 | B2 * | 10/2008 | Ratmansky et al. | 40/27.5 |
| 2002/0092670 | A1 | 7/2002 | Fang et al. | |
| 2004/0035029 | A1 * | 2/2004 | Forsberg | 40/316 |
| 2004/0098890 | A1 * | 5/2004 | Mellgren | 40/316 |
| 2004/0107610 | A1 * | 6/2004 | Gulati | 40/316 |
| 2004/0147176 | A1 * | 7/2004 | Daugherty et al. | 439/769 |

* cited by examiner

*Primary Examiner* — Casandra Davis
*Assistant Examiner* — Christopher E Veraa
(74) *Attorney, Agent, or Firm* — Albert W. Davis, Jr.

(57) ABSTRACT

The invention provides a clip which is used in the identification of the source of power cords, wires and cables. The design of the clip is snag proof. The invention provides pop-out indicia of the source of the cord, wire or cable that is positioned within the clip.

9 Claims, 12 Drawing Sheets

METHODS OF ORGANIZING, IDENTIFYING AND DIFFERENTIATING WIRES, CORDS, CONNECTORS AND OTHER ELONGATED OBJECTS

CROSS-REFERENCE TO RELATED APPLICATIONS

This application is a continuation of non-provisional patent application Ser. No. 11/895,510 filed Aug. 24, 2007 now abandoned, which is a continuation-in-part of provisional patent application Ser. No. 60/840,094 for Method Of Identifying Elongated Objects And The Devices For Doing The Same, filed Aug. 26, 2006.

BACKGROUND OF THE INVENTION

With the abundance of existing electronic products and the constant flood of new ones into the market, there are an endless number of wires, cords, cables, connectors, and tubes with no means of identifying them. This problem reaches across an endless number of industries and applications. Anywhere there are one or multiple cords, cables, connectors, or tubes, identification can be an issue. In the consumer market alone there is an infinite number of electronic devices that need to be identified such as: computers, laptop computers, computer peripherals, cell phones, hand held devices, portable computing devices, mp3 players, radios, CD players, DVD players, alarm clocks, kitchen appliances, radios, home theaters, VCR's, televisions, stereos, hi fis, speakers, subwoofer amplifiers, cordless and cord phones, video recorders, digital cameras, printers, scanners, monitors, fax machines, digital projectors, gaming devices, adapters, chargers, home appliances and housewares, power tools, extension cords, cable extensions, etc. This abundance of wires, cords, cables, connectors and tubes and the inability to identify them can create chaos and confusion as to what leads where. Finding the right wire can be a frustrating trial and error exercise. If a person crosses just one wire, things won't work right or they may end up doing serious damage to the device or themselves.

The identification of the source of power and data transfer cords, wires and cables, tubes, has always been a problem. Computers and their peripherals, home entertainment centers, home theater, electronic gadgets and gaming devices all have many electrical wires, cords, and cables that need to be identified. Other situations which have many electrical cords or cables which carry data that need identification are in: Computer server or network rooms where multiple phone, internet, power, and network wires converge in one area of a building, large (multi-computer) server farms or data banks, large institutions such as schools and hospitals or government buildings, movie and television production sets, and music, film, or television recording studios, large office buildings, factories or manufacturing facilities, and medical offices or laboratories, under the hood of an automobile, in automobile audio installation, in a home wood workshop, in a machining or fabricating shop, on a construction site using power tools, etc.

BRIEF DESCRIPTION OF THE INVENTION

The invention is a device to identify, organize, and differentiate elongated objects such as electrical wires, single wires, tubes, electrical cords or cables, connectors or the like. With every new electronic device, computer peripheral, gadget or product, there comes more wires, tubes, cords, cables, and connectors. This, combined with the already existing wires, cords, tubes, cables, and connectors, becomes an identification and organizational nightmare.

The sea of wires found around entertainment and media centers, computers and computer peripherals, new electronic devices and gadgets, surge protectors or multi-plug outlets, appliances, and power tools led to the development of this device.

With this device, people will never have to unplug the wrong cord again, or reset the clock they accidentally unplugged, or trace each connector (or elongated object) back to see where it came from. It provides a clear and simple way to attach indicia to an elongated object. The application of the device is infinite. It can be applied to almost any industry, home, office, automotive, construction, medical etc. This device can be applied to any elongated object such as wires, cords, cables, tubes, connectors or the like, that need to be identified or differentiated.

The invention is a system to identify, organize, and differentiate wires, cords or cables, and connectors. With every new electronic device, computer peripheral, or gadget comes more wires, cords and connectors. This combined with the already existing wires, cords, and connectors become a cord identification, and organizational nightmare. With the invention, people will never have to unplug the wrong cord again, or trace each connector back to see where it came from, or reset the clock they accidentally unplugged. The invention is an easy to attach, translucent, colored or clear plastic part (a clip). The user applies a supplied icon tab or insert (representing the shape or image of the specific product the cord belongs to) inside the top half which has a transparent portion and then clips it around the appropriate cord. The icons can be printed on bright or glow in the dark material. This feature increases visibility in low light to further aid in cord identification. Blank inserts can be supplied for the user to create their own indicia. The user can create custom indicia by using computer software, an interactive website or the like.

Any person who has ever gone behind an entertainment center to unplug the N, or behind the computer to disconnect a component, or tried to unplug a power tool from a multi-plug outlet has probably unplugged the wrong cord at some time. Anytime multiple wires converge into one localized location or multiple products have the same or similar looking cords, the simple installation of the clip can eliminate or at least reduce, cord identification confusion and frustration. The clip can be applied to all new products as well as existing ones. Through the use of color variation, icon or shape depicting tabs or the possibility of a glow in the dark label, the clip provides people with multiple means to identify and differentiate one cord or wire from another.

There can be different sized clips to accommodate multiple sizes and shapes of cords and wires (small, medium, and large). Each individual sized clip can also have a feature or features to adjust for the variations in shape and size between the small, medium and large sizes. The wire sizes and shapes can include, but are not limited to large cords such as those found on power tools or extension cords down to small wires such as USB cords, AC power supply transformers (class 2 power supply) cords and speaker wires.

The invention can consist of a single plastic molded part or an assembly made up of multiple parts and materials (to be referred to from here on as the clip). The translucent, colored, clear, or opaque (if required by the specific application) plastic clip contains a location and means for applying or attaching indicia such as a symbol, shape or icon representing an object, a letter or a group of letters or text, a number or a group of numbers, an image, or any other identifying mark. The indicia can be applied to a separate flexible or rigid material and then attached to the clip or can be applied directly on the clip. The invention also provides features for attaching and securing to an elongated object with an irregular surface or profile shape.

The indicia can be applied to an additional part and then be attached to the clip, or the indicia may become an integrated molded feature, or it can be applied directly to the clip by any method of applying indicia to a plastic part, such as, printing, stamping, painting or the like. The indicia or identifying marker may be applied to the internal or external surfaces of the clip.

The use of indicia that are shaped like the source of the cord, wire or other elongated object allows for quick identification of the source. By placing the indicia within the clip, the indicia will be protected from things that affect some labels and cause peeling, discoloration, etc. of the label. By providing a tab or insert that is held in the clip by friction or pressure, there is no peeling problem for the indicia.

The clip can include a feature or features to increase visibility in low light. This can be achieved through the use of materials, inks, paints, electronic components, or the like. This feature increases visibility in low light to further aid in identification of an elongated object. Of course, the indicia may also be applied to non-light emitting material or directly on clip.

This device can be manufactured in an infinite number of colors, shapes, sizes and degrees of opacity. For example, the clip or portions thereof can be opaque, translucent, transparent or any combination. The optional colors, opacity, and the ability to apply indicia create an infinite number of solutions for identifying one or both ends of an elongated object (using two clips or a clip and another identifier for both ends).

The invention also includes a way for the consumer to create his or her own icons or graphics (indicia) and print them onto blank plain or glow in the dark sheets with pop out or peel-off inserts. The method of creating the indicia can be in the form of an interactive web site where the consumer can go to create or upload the indicia or a provided, purchased or downloadable software program for creating custom indicia tabs.

DETAILED DESCRIPTION OF THE PREFERRED EMBODIMENTS OF THE INVENTION

Figure 1:
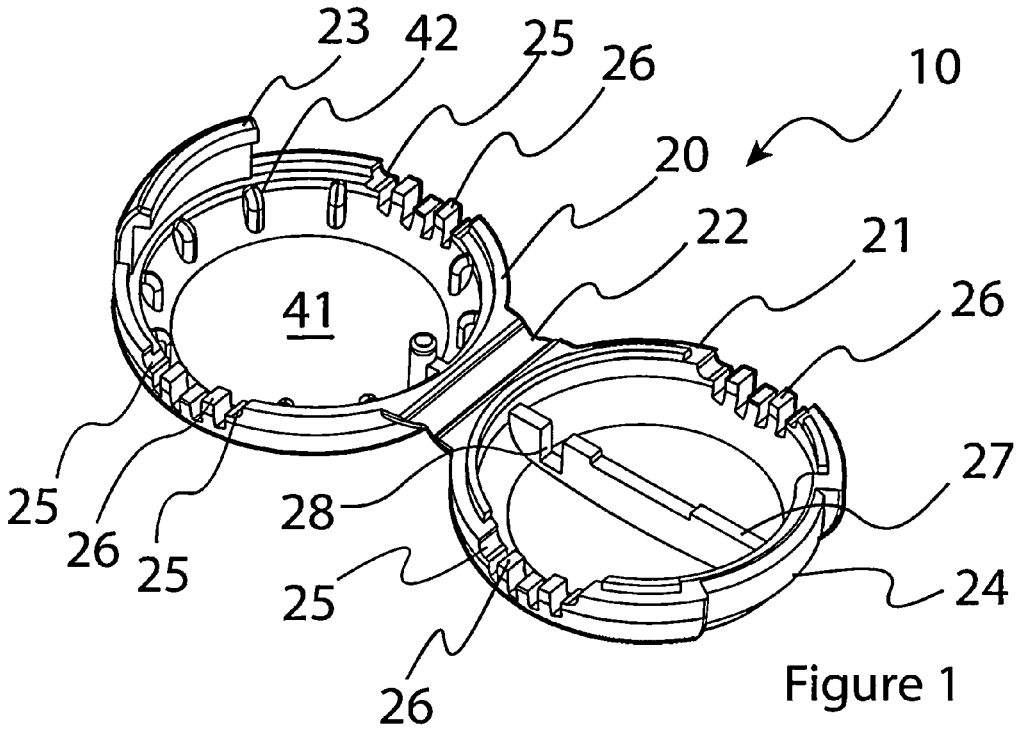
FIGS. 1 and 2 are perspective views of a first embodiment of the invention.
Figure 2:
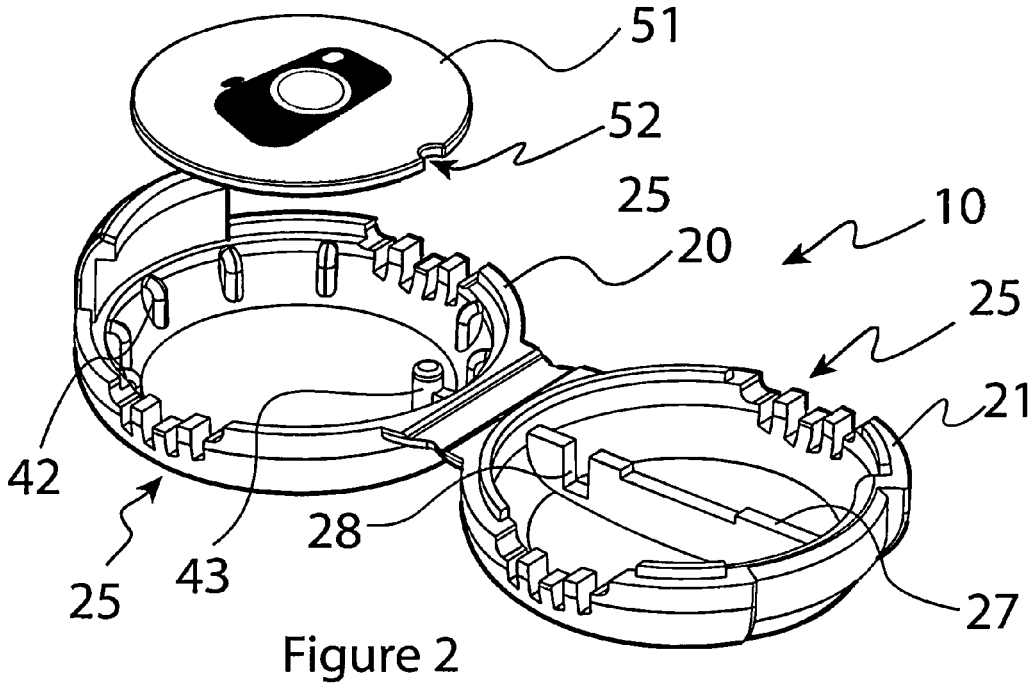

FIGS. 1 and 2 show the clip 10 formed of two sections, top section 20 and bottom section 21, with a "live" hinge 22 joining the sections. Sections 20 and 21 have locking means 23 and 24 to lock the clip on to the cord, wire or cable. The locking means 23 and 24 are male and female members which flex to lock and unlock the clip. A separate locking means can be provided.

Each section 20,21 has an opening 25 with flexible ribs or fins 26 which contact the cord and hold the clip 10 in place on the cord. Ribs 26 may bend to accommodate different size cords.

Figure 14A:
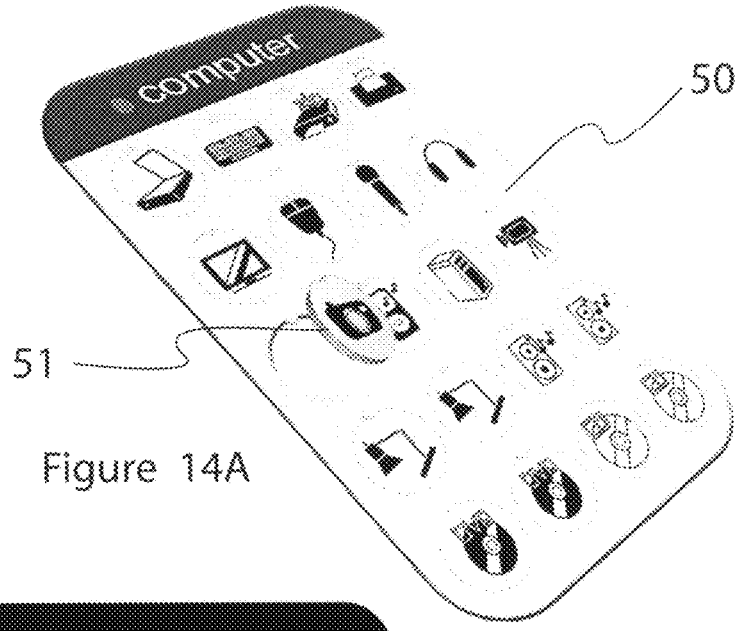
FIGS. 14A and 14B are perspective views of a portion of the invention.
Figure 14B:
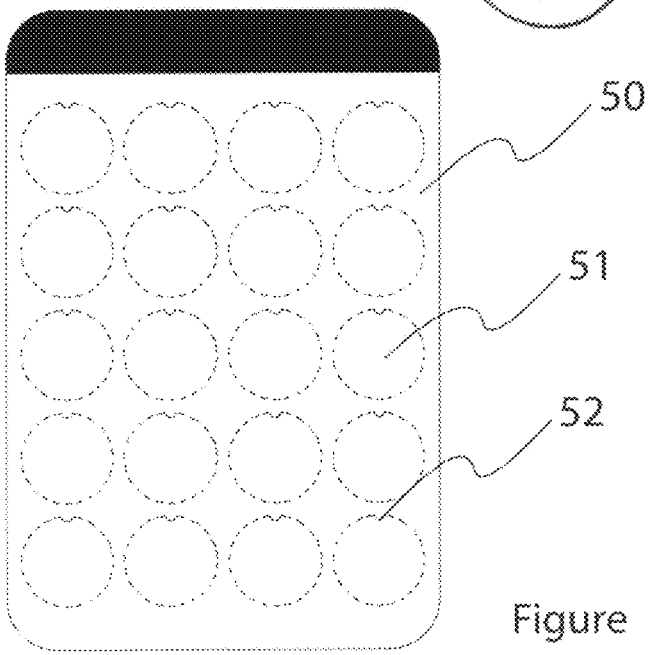

In at least one of the sections 20 or 21, there is a portion 41 which is transparent or translucent. Transparent portion 41 in top section 20 receives an insert 51 which can be popped out of a card 50 provided with the clip (FIGS. 14A and 14B). Each insert 51 has indicia on its surface, such as an icon for a camera, a number, a color, etc. The insert 51 can be held in the transparent portion 41 by frictional fit between the locating ribs 42 and locating post 43 and the insert 51, by closing the clip or by other securing means. There can be a transparent portion 41 in each section 20 and 21. The indicia and/or insert can be formed from materials that glow in the dark.

Alternatively, the clips can have different colors and a matching color decal or element (wire tie, clip, etc.) can be added to the source or cord of the source at a point near the source. In this embodiment, the color of the clip on the cord, wire or cable matches the color on or associated with the source. Also if the source has a color of its own, it is possible to provide a clip with the source at the time of sale that has a matching color as a value added item. Of course, any of the other clips of the invention can be provided at the point of sale of the cord, wire or cable source as a value added item.

Figure 3:
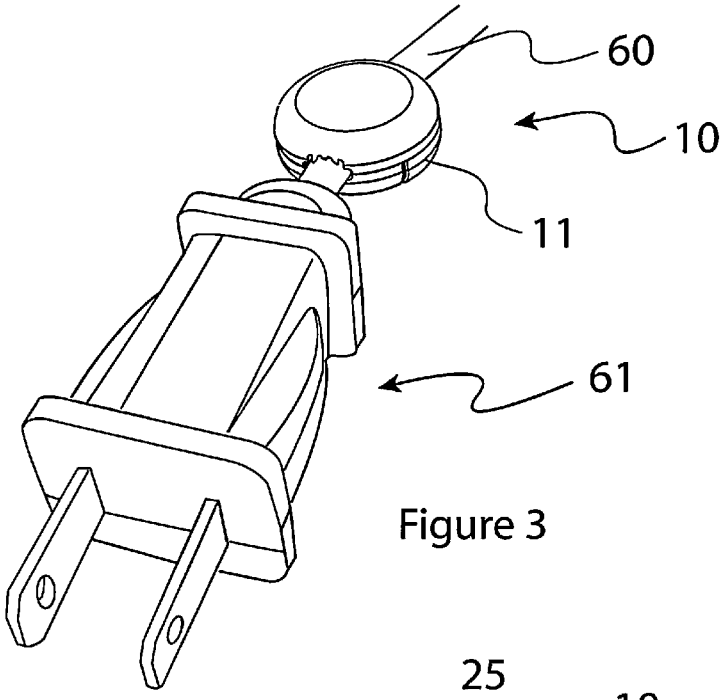
FIG. 3 is a perspective view of the first embodiment of the invention in use.

As shown in FIG. 3, preferably, clip 10 has a round, elliptical or generally curved perimeter 11. The curvature of the perimeter 11 prevents the clip from snagging on other cords, wires or cables. Further, the clip 10 can be the same size or smaller than the width of the plug 61 of the cord 60 or other device on the end of the wire, cord, conduit or cable to help when maneuvering the cord. However, for some people, such as those with poor eyesight, a larger clip and/or indicia may be necessary.

Figure 4:
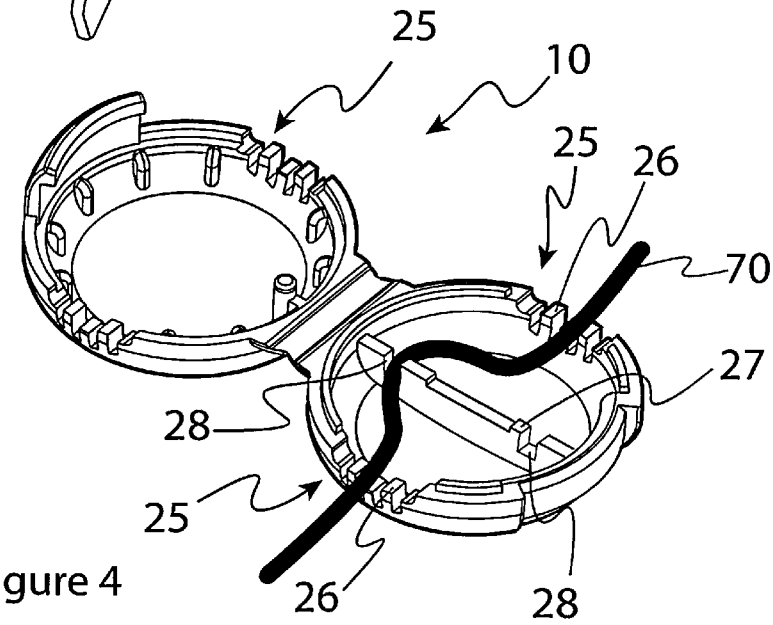
FIG. 4 is a perspective view of a second embodiment of the invention.

FIG. 4 shows the clip 10 on a small diameter elongated member 70. The elongated member 70 is trapped by ribs 26 of openings 25 and by a notch 28 at or near an end area of a ridge 27 within the clip. The wire will be placed in a rib space, the notch, then another rib space. This will help prevent the clip from rotating and/or sliding about the wire.

Figure 5:
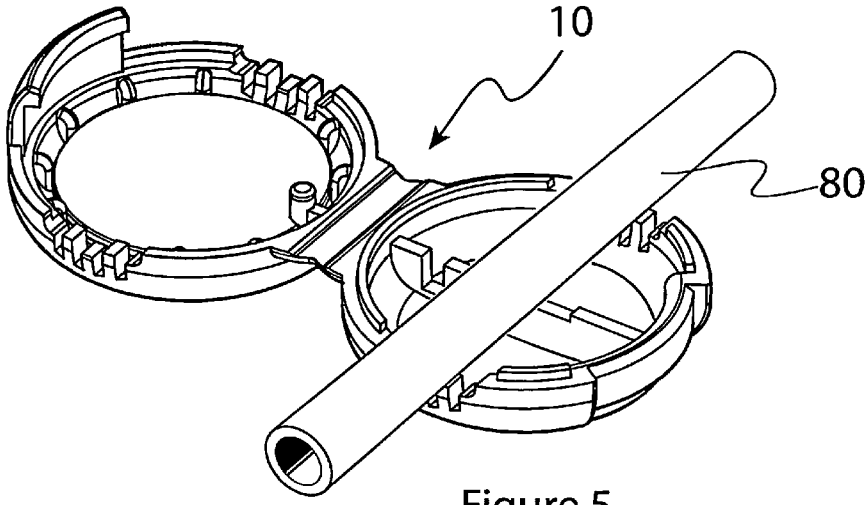
FIGS. 5 and 6 are perspective views of a first embodiment of the invention on a conduit.
Figure 6:
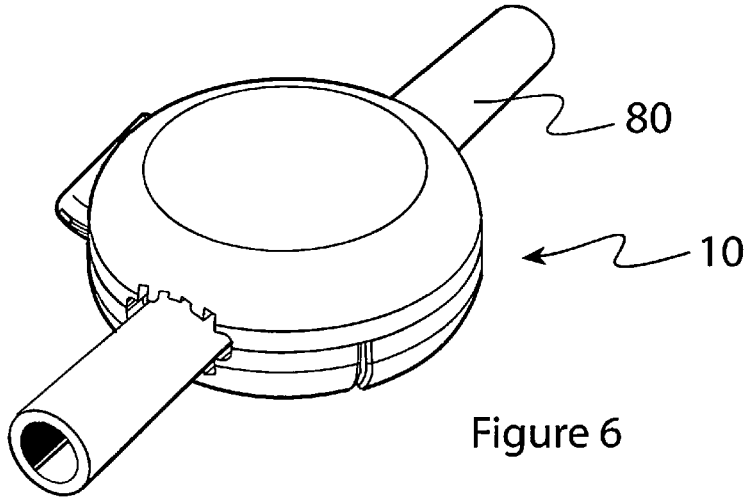

FIGS. 5 and 6 show the clip 10 being used on a conduit 80.

Figure 7A:
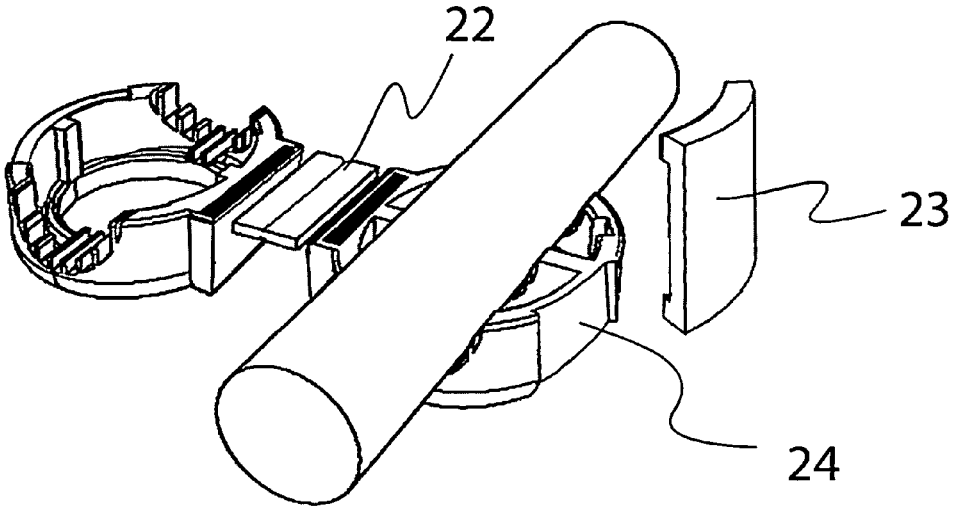
FIGS. 7A and 7B are perspective views of a third embodiment of the invention.
Figure 7B:
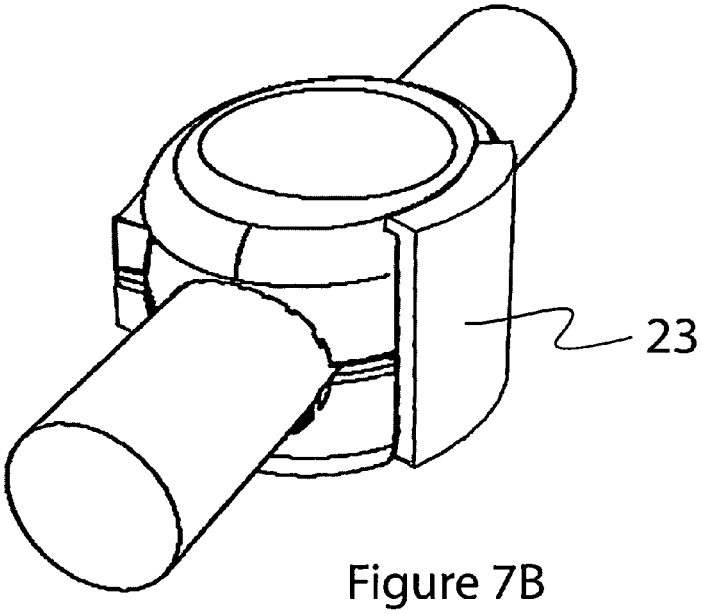
Figure 8A:
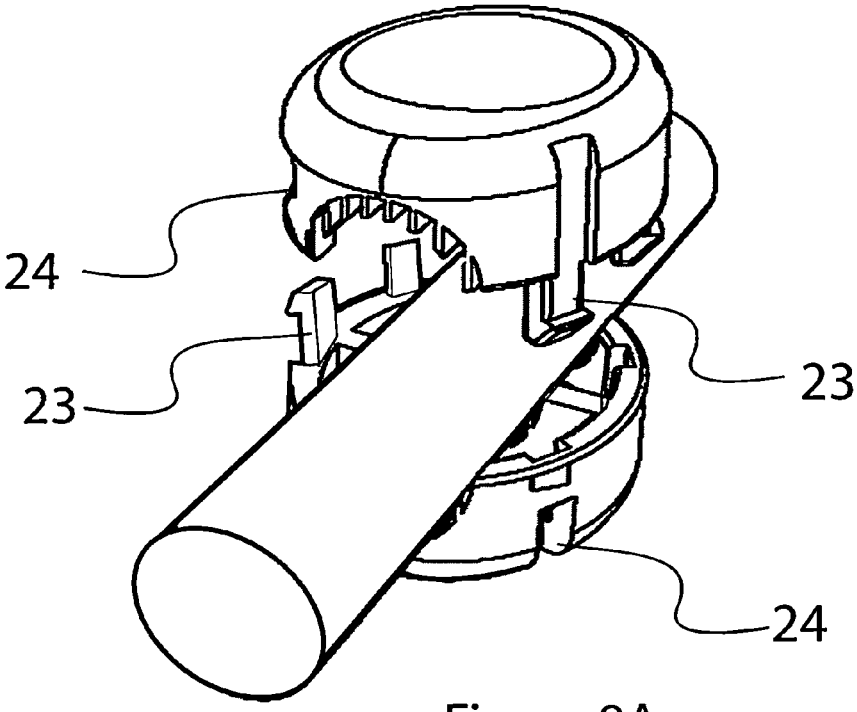
FIGS. 8A and 8B are perspective views of a fourth embodiment of the invention.
Figure 8B:
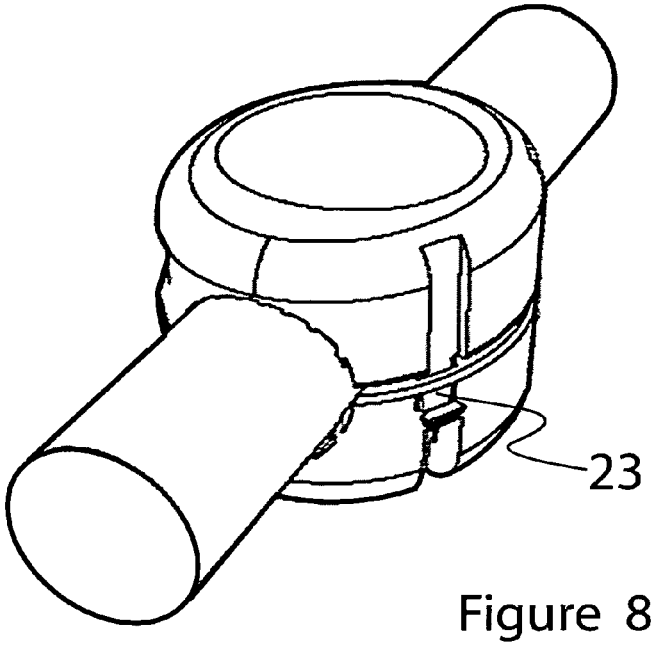

Clip 10 can be manufactured out of a single plastic molded part or an assembly made up of multiple parts and materials. It can be comprised of two mirrored (or non-mirrored) halves folded or connected around an elongated object. The hinging and/or locking geometry can be integral with the clip where the geometry from one half or section locks into the corresponding geometry in the second half or section after being folded around the elongated object or can be one or any combination of the following examples: an integrated molded one piece hinging member and integrated locking geometry, an adhesive (or chemical) bond that connects the two halves together around an elongated object, a separate later "attached" hinge and/or locking mechanism can be used to connect the two halves together around an elongated object (FIGS. 7 A and B), a no hinge design with separate parts in which one part interlocks or bonds (through adhesive or chemical bond) with a second part around an elongated object or identical parts or halves that interlock with each other around the elongated object. (FIGS. 8 A and B).

The molded clip provides a cavity, recess or void 25 or another geometry which allows it to be attached around an elongated object. The clip also provides a means for being attached and secured to elongated objects of variable shape and size. The accommodation of multiple profiles and sizes may be achieved by one or any combinations of the examples listed below.

The clip can be molded as one body or made up of multiple bodies or parts that are added (or attached) to the primary body for the purpose of attaching and securing the clip in a specific location on an elongated object. The features and/or parts of the clip can be manufactured out of soft (flexible) and/or hard (rigid) material.

Figure 9:
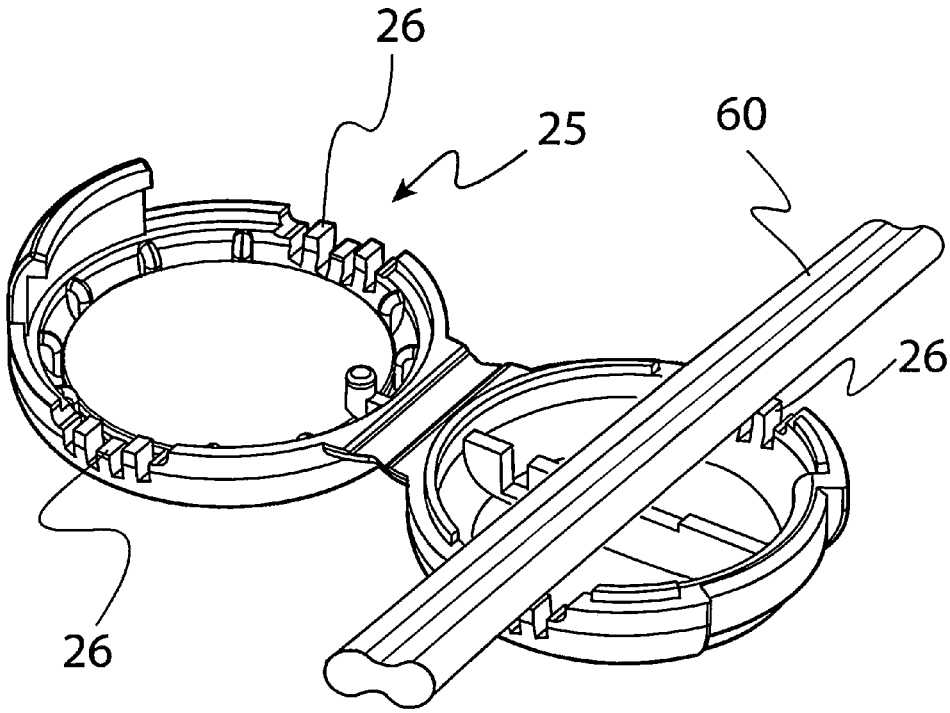
FIG. 9 is a perspective view of a first embodiment of the invention on a differently shaped cord.

When the clip is secured around the elongated object, the flexible or rigid fins, ribs, or posts 26 "grip" into the elongated object and/or flex to accommodate multiple shapes and sizes. This enables one size of clip to be attached to smaller or larger or varied profile elongated objects or cords 60 (FIG. 9).

Figure 10:
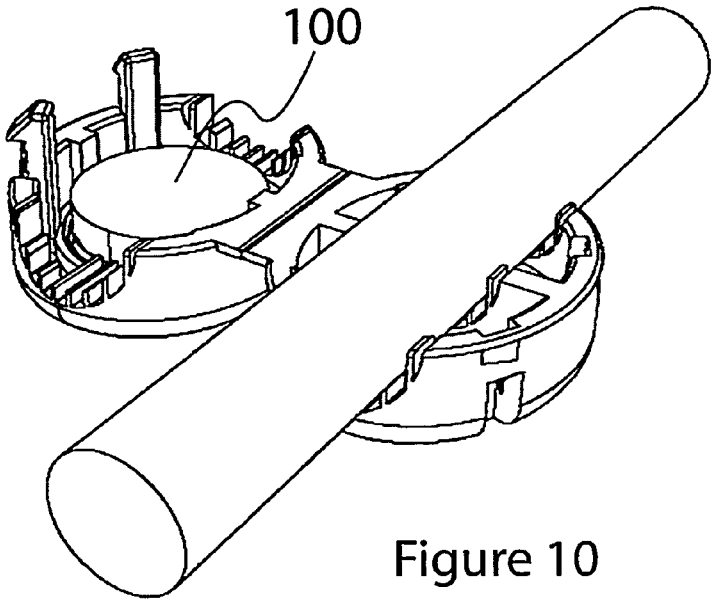
FIG. 10 is a perspective view of a fifth embodiment of the invention.

Soft (flexible) or hard (rigid) rubber, plastic, paper, or like material shims 100 can be added to reduce the size of the cavity or recess within the clip to grip and accommodate multiple shapes and sizes of elongated objects (FIG. 10).

Figure 11:
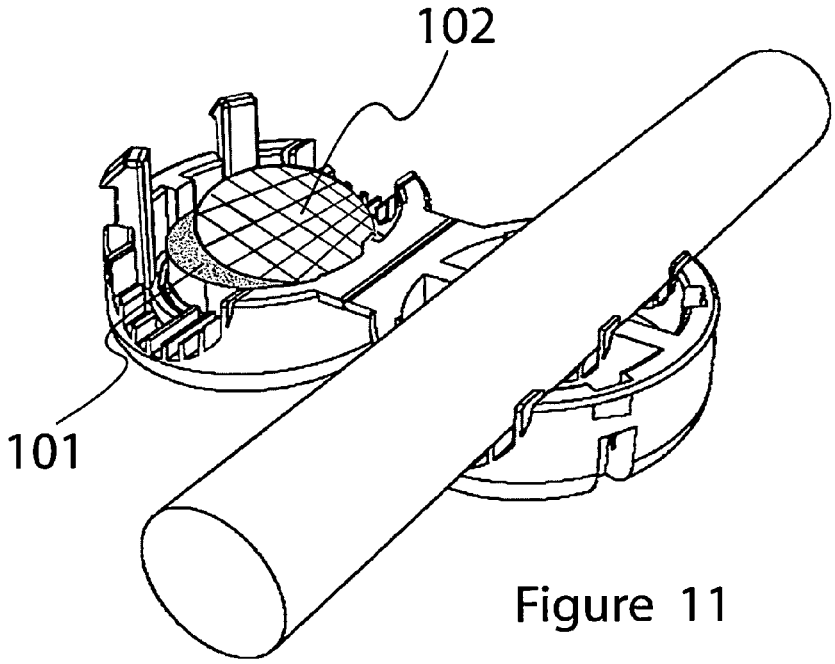
FIG. 11 is a perspective view of a sixth embodiment of the invention.

An adhesive backed soft rubber, plastic, paper, or like material shim 100 can be added in one half of the clip to reduce the size of the cavity or recess to grip and accommodate multiple shapes and sizes (FIG. 11). The shim 100 has a protective backing 102 which is peeled off to expose the adhesive 101 on the shim. The backing 102 is shown as partially peeled.

Figure 12:
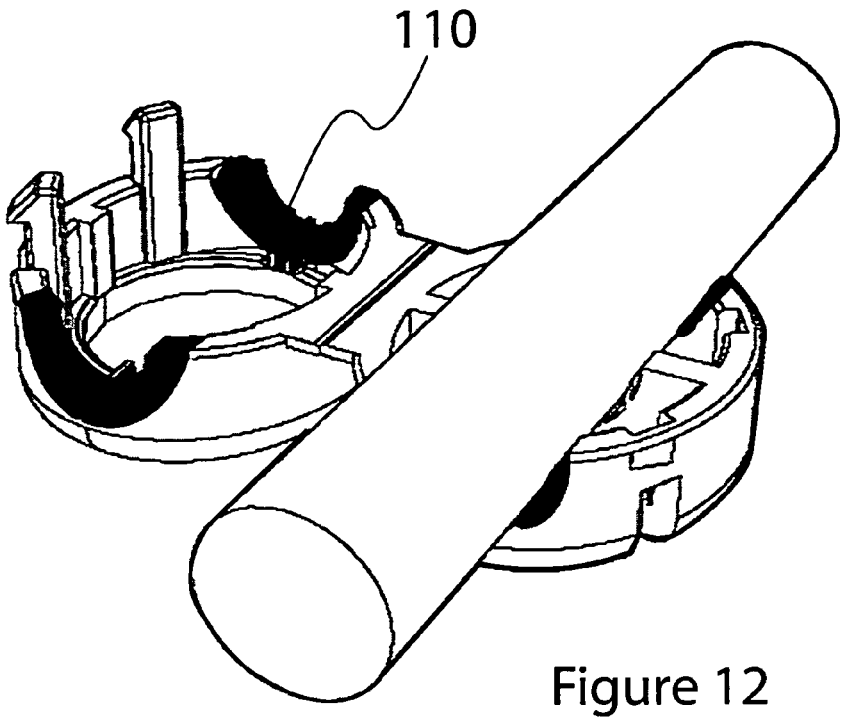
FIG. 12 is a perspective view of a seventh embodiment of the invention.

A soft over-molded or "second shot" 110 of a different material (such as rubber, plastic, or other polymer or like material) can be molded onto the plastic clip to create a means to grip and accommodate multiple shapes, sizes, and variations within an elongated object (FIG. 12).

The clip has been shown with a circular shape. A curved perimeter is preferred since that shape will reduce or eliminate snagging of the clip on other wires, etc. However, this design is not limited to any shape, size, color, or material. The shape, size, color and material of the clip (and indicia) can be infinite.

The indicia can be applied to the clip using a number of possible methods. Indicia can be applied to an additional part and then be attached to the clip. It can become an integrated molded feature, or it can be applied by any method of applying indicia to a plastic part such as, printing, stamping, painting or the like. The indicia may be applied to the internal or external surfaces of the clip. Indicia can be applied, but is not limited to one or any combination of the methods listed below.

Figure 13A:
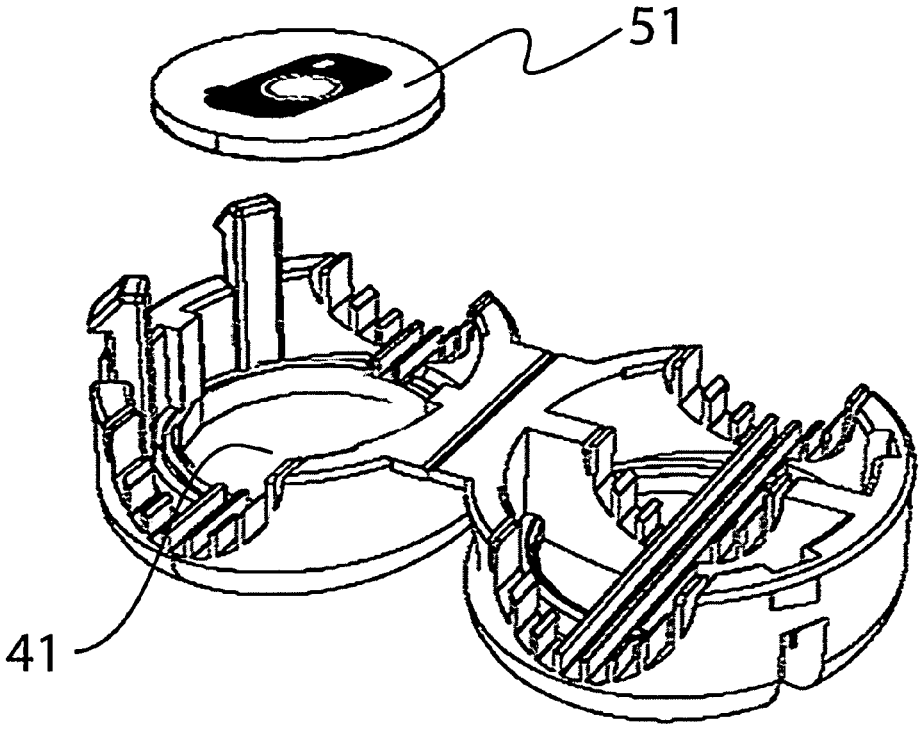
FIGS. 13A and 13B are perspective views of the first embodiment of the invention.
Figure 13B:
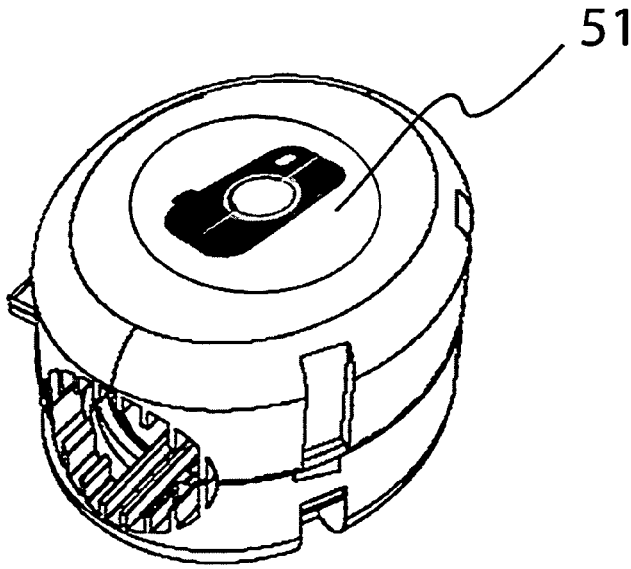

Indicia can be applied to a flexible or rigid part or insert 51 manufactured out of paper, plastic, or like material. The identification insert 51 can then be attached to the inside of the clip at a translucent or transparent viewing window 41 (indicia to be viewed from the outside of the clip) using mechanical, chemical, adhesive or other bonding/attachment means or friction (FIGS. 13 A and B). In FIG. 13A, the insert 51 is shown before insertion with the indicia (camera) facing upward. The insert 51 will be reversed so that the indicia (camera) will be facing downward before insertion into window/transparent portion 41.

Options for the indicia inserts 51 are pre-printed series of images, icons or shapes (representing appliances having cords) or printable sheets or cards 50 with pop-out tabs 51 that are applied to the clip by any suitable means (FIG. 14 A). In FIG. 14B, the tabs 51 are plain, and the indicia can be added by printed decals that can be added to the tabs and retained thereon by bonding agents. The indicia can be provided or can be printed off a website. Cut-out 52 on insert/tab 51 (FIGS. 14 A and B) serves along with locating post 43 to orient the insert in the window portion 41 (FIG. 2).

Figure 15A:
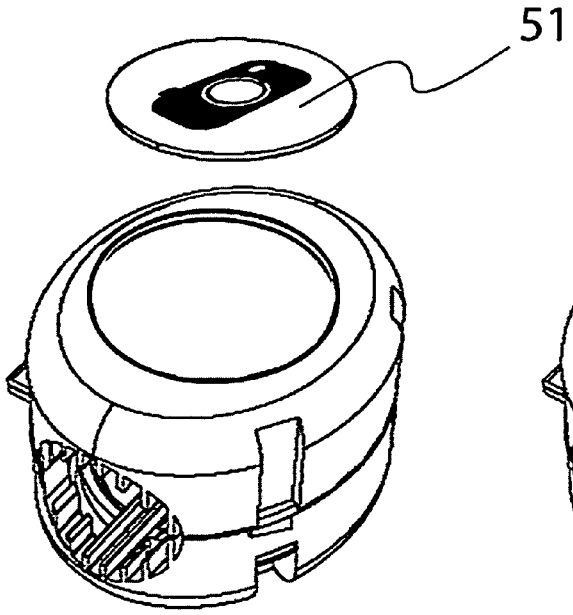
FIGS. 15A and 15B are perspective views of an eighth embodiment of the invention.
Figure 15B:
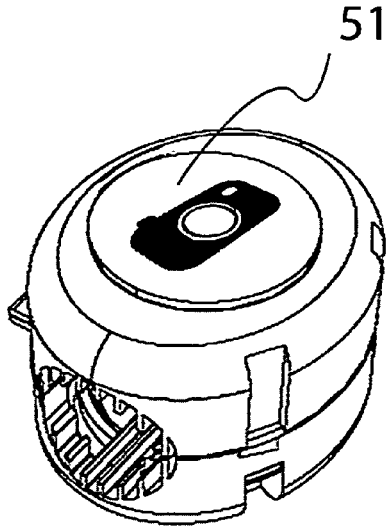

The identification tab or insert 51 (with applied indicia) can also be attached to the outer top or outer bottom surfaces using mechanical, chemical, adhesive or other bonding/attachment means (FIGS. 15 A and B).

Figure 16:
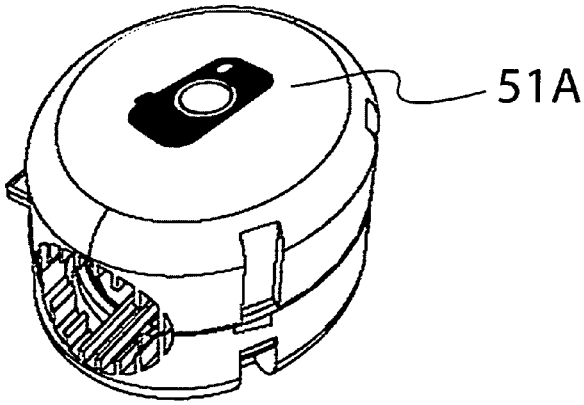
FIG. 16 is a perspective view of a ninth embodiment of the invention.

The identification insert 51A (with applied indicia) can be attached to the outer top or bottom surfaces using methods of printing, hot foil stamping, painting, etching, engraving, or any other process for printing on a plastic part (FIG. 16).

Figure 17:
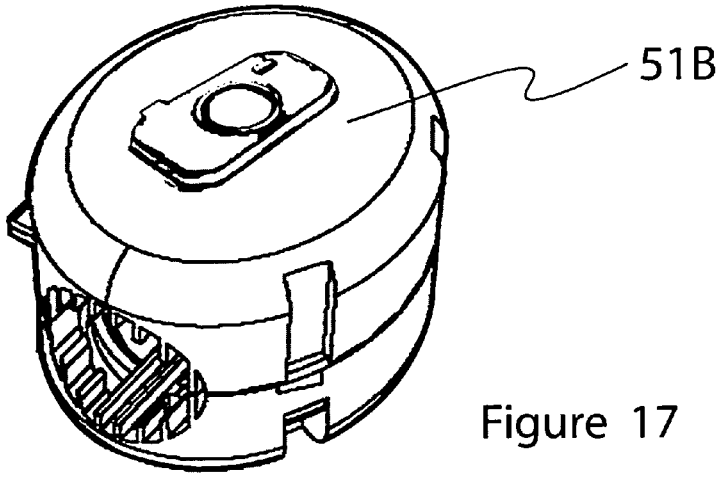
FIG. 17 is a perspective view of a tenth embodiment of the invention.

The part with indicia 51 B can be created directly on the top outer or inner surfaces or the bottom outer or inner surfaces (or both) (FIG. 17). A secondary operation can add color to the directly created indicia.

The indicia can be in the form of Braille printing or symbols for the blind or those without good eyesight. These indicia can be on a decal having raised portions for the printing, symbols or images or molded into the plastic.

The application of indicia to identification part 51 can occur during the manufacturing process, can be applied by the retailer or can be applied by the consumer by any means of applying indicia to the clip or identification marker. The indicia may be added to the part, for example, by ink jet printer, laser printer, pen, ink or color marker, or the like.

An optional element of the invention is a feature for increasing the visibility in low or no light of one or more of the following: the indicia, the insert, the clip, the wire, cord, cable or tube and/or a related object, such as, the plug, an outlet or a receptacle. The light emitting properties can be an integral part of the indicia, the insert or part or the clip. If integrated into the clip, the clip could be made from glow in the dark plastic. Also, the light emitting feature or glow in the dark feature can be achieved by, but is not limited to, one or more of the following options: the indicia is printed on a glow in the dark, highly reflective or bright insert or sticker and then applied to the clip; contrasting inks, glow-in the-dark inks, reflective or high visibility paints or the like are applied directly to the outer or inner surfaces of the clip.

Figure 18A:
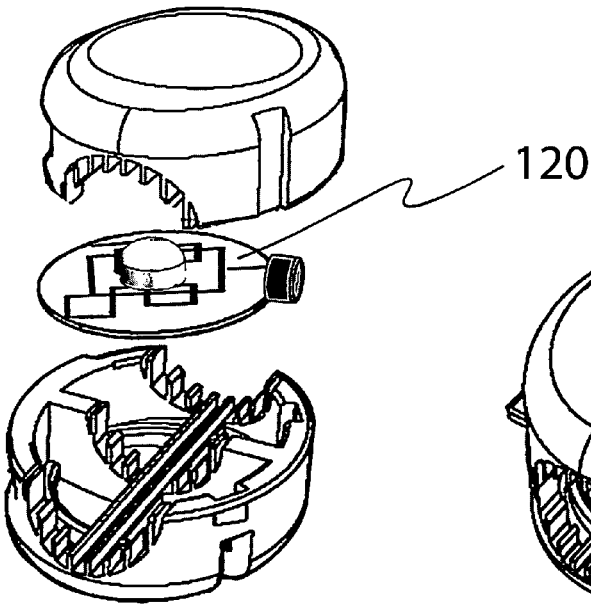
FIGS. 18A and 18B are perspective views of an eleventh embodiment of the invention.
Figure 18B:
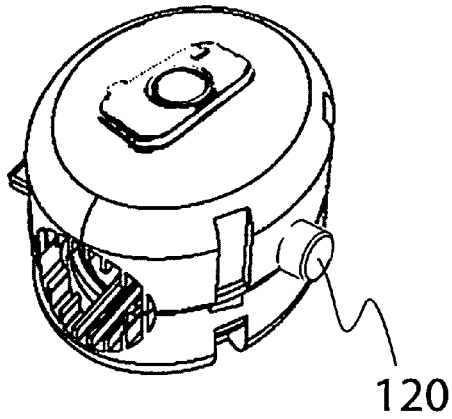

Another option to integrate the emission of light into this device is to provide a secondary light source that utilizes the necessary electronic components to make this light feature operate. This may come in the form of a LED 120 (FIG. 18) with the necessary components to operate it, electroluminescent light, or any other means for lighting the indicia or related objects.

The application of the invention can expand into infinite markets and areas for identifying elongated objects. This device is not limited to any size or shape; the size and shape will be determined by the specific application. It is also not limited to electrical wires or cords; it can be adapted for identifying tubes (for liquid or air). Some of the many other applications where this device can be used are listed below.

In industrial settings such as factories this device can be used to identify tubes, wires, or cables coming to and from the machinery.

In laboratories this device can be used to identify tubes containing different chemicals or materials and wires.

In home audio and car audio this device can be used for identifying the different speaker wires and may also become an aesthetic design element through the use of the colored clip and glowing or back lit indicia.

In hospitals and medical settings this device can be used for identifying any tubes, wires or cords that need to be identified. One example where this may be used is in the identification of IV tubing. The potential for life threatening errors occurs when multiple medications and fluids are administered simultaneously through IV tubing. This device provides a simple way to attach the name of the medication or fluid to the IV tubing. Nurses can print or write on the label, attach the label into the clip, and then carefully snap it around the IV tube.

In computer networking and server applications this device can serve as a tool while the technician is routing wires or serve as permanent identification tag for wires and cords coming to and from the server or junction boxes. This device can also be used as a means for identifying internal wires inside a CPU or server.

In construction or this device can be used for identifying power tools. Electricians can use it as a tool while wiring homes.

This device can also be used by telephone technicians as an identification tool while routing wires or can be used as a permanent identification tag.

The list of applications is infinite. This device can be adapted to identify any and all elongated objects.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

I claim:

1. A method of indicating the source of an electrical cord comprising the following steps, providing a clip made of a plastic material, having an at least translucent area and having a portion to receive and contact the cord on at least two points, the clip having a curved perimeter which is the largest dimension of the clip to prevent snagging, the curved perimeter having two curved portions intersecting the cord, the at least translucent area being completely within the curved perimeter, the curved perimeter lying in a first plane substantially parallel to a second plane, the second plane having the at least two contact points of the cord within the second plane, providing a locking means to lock the clip on to the cord, providing an insert having a surface, the surface having indicia identifying the source of the electrical cord, the clip having locating ribs to frictionally hold the insert, placing the insert within the clip in a position so that the indicia can be seen through the at least translucent area, placing the clip on the cord and locking the clip on to the cord by using the locking means.

2. The method of claim 1 wherein, the clip and the insert having mating means to assure alignment of the indicia on the insert relative to the at least translucent area in only one orientation.

3. The method of claim 1 wherein, the portion receiving and contacting the cord on at least two points having flexible ribs contacting the cord to enable various sizes and shapes of cords to be accommodated.

4. The method of claim 1 wherein, the indicia identifying the source is a color.

5. The method of claim 4 wherein, the color of the indicia is matched by a decal having the same color which is added at a point near the source of the electrical cord.

6. The method of claim 1 wherein, the indicia identifying the source is a number.

7. The method of claim 6 wherein, the number on the indicia is matched by a decal having the same number which is added at a point near the source of the electrical cord.

8. A method of indicating the source of an electrical cord comprising the following steps, providing a clip made of a plastic material, having an at least translucent area and having a portion to receive and contact the cord on at least two points, the clip having a curved perimeter which is the largest dimension of the clip to prevent snagging, the curved perimeter having two curved portions intersecting the cord, the at least translucent area being completely within the curved perimeter, the curved perimeter lying in a first plane substantially parallel to a second plane, the second plane having the at least two contact points of the cord within the second plane, providing a locking means to lock the clip on to the cord, providing an insert having a surface, the surface having indicia identifying the source of the electrical cord, the clip and the insert having mating means to assure alignment of the indicia on the insert relative to the at least translucent area in only one orientation, placing the insert within the clip in a position so that the Indicia can be seen through the at least translucent area, placing the clip on the cord and locking the clip on to the cord by using the locking means.

9. The method of claim 8 wherein, the means to assure alignment of the indicia on the insert relative to the at least translucent area in only one orientation being a locating post on the clip and a notch in the insert.

* * * * *